United States Patent [19]

Morgenthaler

[11] Patent Number: 4,462,242

[45] Date of Patent: Jul. 31, 1984

[54] METHOD FOR WIRE DRAWING

[75] Inventor: Allen C. Morgenthaler, Clearwater, Fla.

[73] Assignee: GK Technologies, Incorporated, Greenwich, Conn.

[21] Appl. No.: 413,978

[22] Filed: Sep. 2, 1982

Related U.S. Application Data

[63] Continuation of Ser. No. 128,377, Mar. 10, 1980, abandoned.

[51] Int. Cl.[3] ..... B21C 9/00; B21C 3/00

[52] U.S. Cl. ..... 72/467; 425/183

[58] Field of Search ..... 72/467, 468; 425/183, 425/184, 190, 461

[56] References Cited

U.S. PATENT DOCUMENTS

| | | | |
|---|---|---|---|
| 2,363,406 | 4/1944 | Ferrier | 72/467 |
| 2,394,720 | 2/1946 | Scrantom | 72/467 X |
| 4,241,625 | 12/1980 | Corbin et al. | 72/467 |
| 4,260,397 | 4/1981 | Bovenkerk | 72/467 |
| 4,270,373 | 6/1981 | Hirolo | 72/467 |

*Primary Examiner*—Leon Gilden

*Attorney, Agent, or Firm*—Hopgood, Calimafde, Kalil, Blaustein & Judlowe

[57] ABSTRACT

This disclosure relates to the construction and method of using synthetic diamond dies for drawing wire through a land or throat of a passage through the diamond die with the land or throat located midway between the opposite sides of the synthetic diamond and with approach passages located at opposite ends of the land so that the wire can be pulled through the die in either direction. This increases the useful life of the die before it becomes necessary to resize the die. The object of the invention is to reduce the cost of wire drawing through synthetic diamond dies.

4 Claims, 2 Drawing Figures

METHOD FOR WIRE DRAWING

This application is a continuation of copending application Ser. No. 128,377 filed Mar. 10, 1980, now abandoned.

PRIOR ART

Most of the prior art with which applicant is familiar relates to synthetic diamond dies, disclosed in patents of the General Electric Company. General Electric makes and sells synthetic diamonds to die manufacturers, but applicant's experience with General Electric is that General Electric will not fabricate synthetic diamonds into wire drawing dies for its customers.

The most pertinent prior art appears to be the following U.S. Pat. Nos. 2,407,495; 2,363,406; 3,141,855; 3,078,232; 3,148,161; 2,941,248; 3,407,445; 3,743,489; 3,744,982; 3,745,623; 3,831,428 and 4,016,736.

In view of the extensive prior art, and in order to prevent the specification of this patent application from being excessive in length, a discussion of the prior art is submitted herewith as a separate disclosure statement.

BACKGROUND AND SUMMARY OF THE INVENTION

Wire drawing dies made with natural diamonds have two disadvantages. One is that natural diamonds are not as strong as synthetic diamonds and there is risk of the diamond breaking under the force required for drawing wire. Much more important disadvantage is that natural diamonds are crystalline and do not wear evenly. This requires drilling to a larger size die after an unpredictable length of time during which the die wears unevenly so that it is no longer suitable for producing wire of round cross section and of the original diameter for which the die was made.

Polycrystalline synthetic diamonds wear like amorphous materials and their wear is even and predictable. The lack of cleavage lines practically negates the high degree of breakage encountered with natural diamonds.

The synthetic diamond die of this application has a throat of substantially uniform diameter throughout its length and with wearing surface that maintains contact with the circumference of the wire throughout substantially the entire length of the throat. Beyond each end of the throat there are tapered walls which differ in their angle of taper depending upon the material of the wire with which the die is intended to be used. These tapered passages, at opposite ends of the throat are referred to herein as approach passages and the one at the upstream end of the throat reduces the cross section of the wire as the wire moves toward the throat. The tapered passage at the downstream end of the throat constitutes the approach passage when the wire is being drawn through the die in the opposite direction. The throat is substantially cylindrical and equal in diameter to the downstream diameter of the approach passages in which the reduction in wire diameter is effected. By using the die in such a way that each end of the die is the upstream end substantially half of the time that the die is in use, the wear on the approach passages is much less and the service life of the die substantially twice as long as it would otherwise be. Experience has shown that such is the case.

The taper of the passages as they approach the throat are referred to as the "drawing angle." At the ends of the tapered passages, there is a short length of each passage which has a larger angle of taper and these ends with the larger angle of taper are referred to as the "bell" of the passage.

DESCRIPTION OF PREFERRED EMBODIMENT

Figure 2:
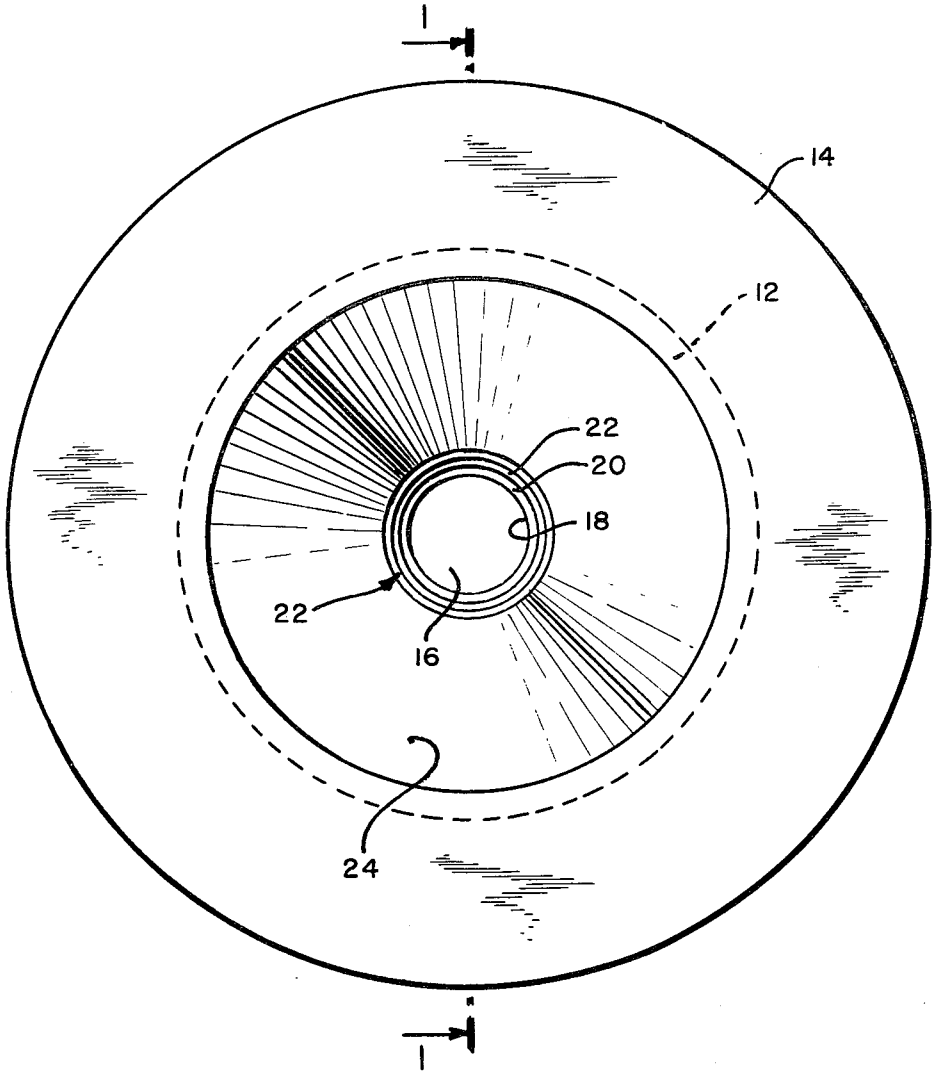
FIG. 2 is an elevation of the die shown in FIG. 1 when viewed from either side.

A synthetic diamond nib 12 is located in the center of a synthetic diamond die case 14. A passage 16 extends through the center of the cylindrical synthetic diamond nib 12.

Passage 16 has a center throat 18 which is preferably cylindrical and equally spaced from opposite ends of the passage 16. Tapered walls 20 and 20' extend from opposite ends of the throat 18 and diverge as they extend away from the throat 18 at angles which depend upon the kind of material for which the die is to be used. For example, the passages formed by the walls 20 and 20', which are preferably identical to one another, may have an included angle of 16 degrees for one kind of metal and a smaller included angle of 11 degrees for a different kind of metal. These angles are well known in the wire drawing art.

Toward each end of the passage 16 the tapered walls 20 and 20' increase to a greater included angle that approaches 90 degrees at each end of the passage 16 to form a bell 22. Beyond each end of the nib 12, the case 14 has a case countersink 24 which has a diameter, adjacent to the passage through the nib, somewhat larger than the maximum diameter of the bell 22 at each end of the passage through the nib 12.

Figure 1:
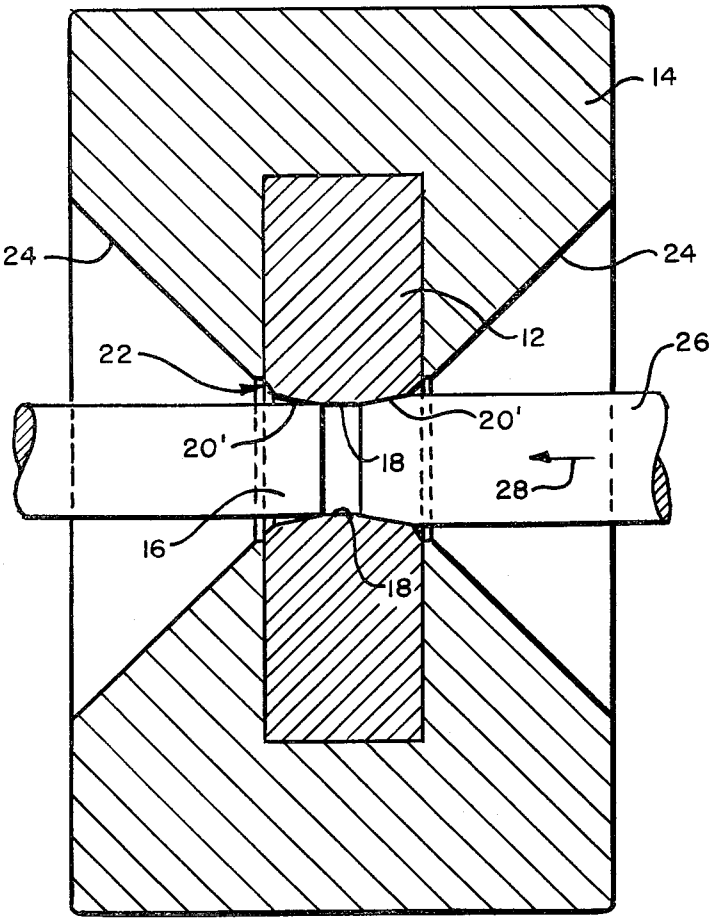
FIG. 1 is a sectional view through the die made in accordance with this invention.

When used for drawing wire, the wire can be pulled through the nib in either direction. In FIG. 1, a wire 26 is drawn through the passage 16 in the nib 12 in the direction indicated by the arrow 28. The outside diameter of the wire contacts with the sloping face 20 and is reduced in diameter as it approaches the throat 18.

The throat 18 is cylindrical and the wire 16 is reduced in diameter as it approaches the throat 18 along the tapered wall 20. As the wire 26 leaves the throat 18, it is reduced to a smaller diameter substantially equal to that of the throat 18.

After the nib 12 has been used for drawing wire introduced into the die in the direction of the arrow 28, further use of the die for drawing other lengths of wire substantially identical to the wire 26 introduces the wire into the nib from the opposite direction so that the tapered wall 20' reduces the diameter of the wire in the same manner as the sloping face 20. This die with a cylindrical throat and sloping faces 20 and 20' greatly increases the life of the die since the wear is distributed between the tapered faces 20 and 20' as it is reduced in diameter as it approaches the throat 18 which is cylindrical.

In addition to the materials already referred to, the synthetic diamond die case 14 may be made of tungsten carbide. The die geometry may be formed initially by various means, mechanical, laser, etc. All portions of the opening through the die are coaxial with one another. The case 14 is made of metal such as stainless steel and monel metal.

The preferred embodiment of the invention has been illustrated and described, but changes and modifications can be made and some features can be used in different combinations without departing from the invention as defined in the claims.

What is claimed is:

1. The method of drawing wire through a synthetic diamond die with a land located substantially midway between opposite faces of the synthetic diamond providing tapered approach passages at opposite ends of the land and of substantially the same length as one another and with substantially the same angle of taper, drawing wire through the die in one direction for a period of time and then drawing wire through the die in the opposite direction, and approximating the time in which wire is pulled through the die so that the movement in opposite directions is alternated and wear on the die is distributed more uniformly between opposite ends thereof.

2. The method of wire drawing described in claim 1 characterized by drawing wire through the die in one direction until it is time to clean the end of the die that has been in use, cleaning the die, and pulling wire through the die in the opposite direction the next time the die is used in order to increase substantially the useful life of the die.

3. The method of substantially extending the length of wire that may be drawn through a synthetic diamond die having a drawing passage between front and back surfaces, which method comprises contouring the passage to establish a cylindrical throat of substantially uniform cross-section and midway between the front and back surfaces, providing identical conically tapered passage portions at opposite ends of the throat portion and with progressively increasing cross-section as they extend from opposite ends of the throat to the respective front and back surfaces of the die, drawing wire through the die in the front-to-back direction for a first predetermined period of time, thereby localizing die wear in proximity to one to the exclusion of the other end region of said throat, then reversing the die and drawing wire therethrough in the back-to-front direction for a second predetermined period of time, thereby localizing die wear in proximity to the other end region to the exclusion of said one end region, whereby die wear for said directions of wire drawing does not involve cumulative wear in any given single location within the passage.

4. The method of substantially extending the length of wire that may be drawn through a wire-drawing die, which comprises selecting a synthetic diamond die having a drawing passage between front and back surfaces, the passage having a cylindrical throat of substantially uniform cross-section and midway between the front and back surfaces, and the passage having identical but oppositely direction outwardly flaring tapered passage portions from opposite ends of the throat portion to the respective front and back surfaces of the die, drawing wire through the die in the front-to-back direction for a first predetermined period of time, thereby localizing die wear in proximity to one to the exclusion of the other end region of said throat, then reversing the die and drawing wire therethrough in the back-to-front direction for a second predetermined period of time, thereby localizing die wear in proximity to the other end region to the exclusion of said one end region, whereby die wear for said directions of wire drawing does not involve cumulative wear in any given single location within the passage.

* * * * *

REEXAMINATION CERTIFICATE (904th)

United States Patent [19]

[11] B1 4,462,242

Morgenthaler

[45] Certificate Issued Jul. 26, 1988

[54] METHOD FOR WIRE DRAWING

[75] Inventor: Allen C. Morgenthaler, Clearwater, Fla.

[73] Assignee: GK Technologies, Incorporated, Greenwich, Conn.

Reexamination Request:
No. 90/001,135, Dec. 5, 1986

Reexamination Certificate for:

| | |
|---|---|
| Patent No.: | 4,462,242 |
| Issued: | Jul. 31, 1984 |
| Appl. No.: | 413,978 |
| Filed: | Sep. 2, 1982 |

Related U.S. Application Data

[63] Continuation of Ser. No. 128,377, Mar. 10, 1980, abandoned.

[51] Int. Cl.[4] ..... B21C 9/00; B21C 3/00
[52] U.S. Cl. ..... 72/467; 425/183
[58] Field of Search ..... 72/467, 468; 425/183, 425/184, 190, 461

[56] References Cited

U.S. PATENT DOCUMENTS

| | | | |
|---|---|---|---|
| 678,789 | 7/1901 | McCool . | |
| 2,941,248 | 6/1960 | Hall . | |
| 3,078,232 | 2/1963 | Wentorf, Jr. . | |
| 3,141,855 | 7/1964 | Wentorf, Jr. . | |
| 3,148,161 | 9/1964 | Wentorf, Jr. . | |
| 3,407,445 | 10/1968 | Strong . | |
| 3,743,489 | 7/1973 | Wentorf, Jr. et al. . | |
| 3,744,982 | 7/1973 | Bovenkerk et al. . | |
| 3,831,428 | 8/1974 | Wentorf, Jr. et al. | 72/467 |
| 4,016,736 | 4/1977 | Carrison et al. | 72/467 |

FOREIGN PATENT DOCUMENTS 775521 1/1979 South Africa .

OTHER PUBLICATIONS

Grodzinski, P., *Diamond Technology*, N.A.G. Press, Ltd, London, 1953, p. 577.

Gruhn, H. H., "Maintenance and Inspection of Diamond Drawing Dies" from *Wire World International*, vol. 11, Jul./Aug., 1969, pp. 153–157.

Smith, N. R., *Industrial Applications of the Diamond*, Hutchinson & Co., London, 1965, pp. 287–298.

Wistreich, J. G., et al, *The Fundamentals of Wire Drawing, Metallurgical Reviews*, vol. 3, No. 10, 1958, pp. 97–142.

Pomp, A., *Steel Wire*, The Wire Industry, Ltd., London, England, 1954, pp. 143–167.

Daniel, Paul, *Ultrahard Materials Application Technology*, vol. 2, 1983, pp. 81–91.

*Die Service Manual, Carboloy*, Manual D-119, Oct. 1, 1945, p. 49.

*Wire Journal*, U.S. Industrial Publications, Stamford, Conn.,: vol. 1, No. 7, Oct. 1968, p. 68; vol. 2, No. 2, Feb., 1969, p. 79; vol. 2, No. 5, May, 1969, p. 93; vol. 2, No. 9, Sep., 1969, pp. 32, 33, 223; vol. 3, No. 10, Oct., 1970, p. 68; vol. 4, No. 9, Sep., 1971, p. 78; vol. 5, No. 9, Sep., 1972, p. 70; vol. 6, No. 9, Sep. 1973, p. 84.

Christopherson, D. G., et al, "Promotion of Fluid Lubrication in Wire Drawing" from *Wire Industry*, Aug., 1955, pp. 775–777 and 885–887.

*Wire and Wire Products*, Quinn-Brown Publishing Corp., Stamford, Conn.: vol. 29, No. 9, Sep., 1954, p. 1005; vol. 29, No. 10, Oct., 1954, pp. 1230, 1239, 1240; vol. 30, No. 2, Feb., 1955, pp. 215, 222; vol. 30, No. 5, May, 1955, p. 576; vol. 30, No. 10, Oct., 1955, p. 1278; vol. 34, No. 10, Oct., 1959, p. 1383; vol. 35, No. 6, Jun., 1960, p. 792; vol. 35, No. 7, Jul., 1960, p. 924; vol. 35, No. 10, Oct., 1960, p. 1435; vol. 35, No. 11, Nov., 1960, p. 1594; vol. 35, No. 12, Dec., 1960, p. 1723; vol. 36, No. 2, Feb., 1961, p. 264; vol. 36, No. 3, Mar., 1961, p. 398; vol. 36, No. 10, Oct., 1961, p. 1306; vol. 36, No. 11, Nov. 1961, p. 1508; vol. 36, No. 12, Dec. 1961, p. 1737; vol. 37, No. 1, Jan., 1962, p. 134; vol. 37, No. 3, Mar., 1962, p. 412; vol. 37, No. 4, Apr., 1962, p. 548; vol. 37, No. 5, May 1962, p. 686; vol. 37, No. 10, Oct., 1962, p. 1530; vol. 37, No. 11, Nov., 1962, p. 1672; vol. 38, No. 1, Jan., 1963, p. 139; vol. 38, No. 7, Jul., 1963, p. 1031; vol. 38, No. 12, Dec., 1963, p. 1931; vol. 39, No. 1, Jan., 1964, p. 145; vol. 39, No. 2, Feb., 1964, p. 298; vol. 39, No. 3, Mar., 1964, p. 451; vol. 39, No. 9, Sep., 1964, p. 1388; vol. 40, No. 1, Jan., 1965, p. 149; vol. 40, No. 3, Mar., 1965, p. 437; vol. 40, No. 8, Aug., 1965, p. 1189; vol. 41, No. 2, Feb., 1966, p. 314; vol. 41, No. 3, Mar., 1966, p. 478; vol. 42, No. 4, Apr., 1967, p. 527; vol. 43, No. 2, Feb., 1968, p. 115; vol. 43, No. 11, Nov., 1968, p. 115; vol. 2, No. 2, Feb., 1969, p. 79; Dec., 1968, p. 113; vol. 2, No. 5, May, 1969, p. 93; vol. 46, No. 5, May, 1971, p. 49; vol. 47, No. 10, Oct., 1972, p. 84; vol. 33, No. 10, Oct. 1958, p. 1122; vol. 16, No. 12, Dec., 1941, pp. 743–746, 770, 771, Aug., 1955, pp. 886, 887; and, Oct. 1936, pp. 553–559.

*Primary Examiner*—Daniel C. Crane

[57] ABSTRACT

This disclosure relates to the construction and method of using synthetic diamond dies for drawing wire through a land or throat of a passage through the diamond die with the land or throat located midway between the opposite sides of the synthetic diamond and with approach passages located at opposite ends of the land so that the wire can be pulled through the die in either direction. This increases the useful life of the die before it becomes necessary to resize the die. The object of the invention is to reduce the cost of wire drawing through synthetic diamond dies.

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4 are cancelled.

* * * * *